US006733840B2

(12) United States Patent
Byrne et al.

(10) Patent No.: US 6,733,840 B2
(45) Date of Patent: May 11, 2004

(54) SILICONE COMPOSITIONS FOR TEXTILE APPLICATIONS

(75) Inventors: Christopher Michael Byrne, Ithaca, NY (US); Matthew David Butts, Rexford, NY (US); Kathryn Ann Shaffer, Clifton Park, NY (US); Steven James Stoessel, Niskayuna, NY (US); Michael Craig Burrell, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 10/162,394

(22) Filed: Jun. 5, 2002

(65) Prior Publication Data

US 2003/0228419 A1 Dec. 11, 2003

(51) Int. Cl.[7] ..... B05D 3/02
(52) U.S. Cl. ..... 427/387; 427/392
(58) Field of Search ..... 427/387, 389.9, 427/392

(56) References Cited

U.S. PATENT DOCUMENTS

| | | | | |
|---|---|---|---|---|
| 3,494,788 A | * | 2/1970 | Bey | 428/96 |
| 3,628,907 A | | 12/1971 | Fish | |
| 4,113,947 A | * | 9/1978 | Deiner et al. | 544/196 |
| 4,549,880 A | | 10/1985 | Hendrix et al. | |
| 4,619,864 A | | 10/1986 | Hendrix et al. | |
| 4,645,691 A | | 2/1987 | Ozaki et al. | |

FOREIGN PATENT DOCUMENTS

| | | | |
|---|---|---|---|
| CN | 1285432 | * | 2/2001 |
| EP | 0255205 | | 3/1988 |
| FR | 1474558 | * | 3/1967 |
| JP | 63-264506 | * | 11/1988 |
| WO | WO 00/40210 | * | 7/2000 |
| WO | WO 02/06382 | * | 1/2002 |
| WO | WO 02/06383 | * | 1/2002 |

OTHER PUBLICATIONS

"Poly–Functionalization of Polysiloxanes—New Industrial Opportunities", S. Breunig, J. Chardon, N. Guennouni, G. Mignani, P. Olier, A. van der Spuy, Organosilicon Chem. IV, 2000, pp. 645–658.

* cited by examiner

*Primary Examiner*—Erma Cameron
(74) *Attorney, Agent, or Firm*—Andrew J. Caruso; Patrick K. Patnode

(57) ABSTRACT

A method for treating a cellulose-containing substrate is provided in the present invention, the method comprising contacting a silicone composition comprising at least one polysiloxane or silicone resin containing at least one functional group comprising at least one dialkylacetal group, at least one anhydride group, at least one reactive group, or combinations thereof with the cellulose-containing substrate; and curing the silicone composition on the cellulose-containing substrate at a temperature in a range between about 25° C. and about 200° C. A further embodiment of the present invention includes a formulation containing the aforementioned silicone composition.

9 Claims, No Drawings

SILICONE COMPOSITIONS FOR TEXTILE APPLICATIONS

BACKGROUND OF THE INVENTION

The present invention relates to compositions for textile applications. More particularly, the present invention relates to silicone compositions which adhere durably to textiles.

Silicones are used in the textile industry due in part to the unique benefits that they impart to the materials, such as softness. One problem in the industry is lack of durability in fabric treatments. In many applications, the silicone is deposited on textile surfaces and is often held only by weak physical forces. For instance, treatment of textiles with silicones containing amino or quaternary functional groups can result in benefits that display some durability. However, these polymers are believed to bond ionically or through hydrogen bonding with cellulosic surfaces. Because the interactive forces are weak, the benefits of silicone treatments are often short lived.

It is therefore desirable to produce silicone compositions which can be used to treat textiles and provide durable benefits. Thus, silicone products are constantly being sought which can both adhere durably to textiles as well as impart textile benefits appreciated by consumers.

BRIEF SUMMARY OF THE INVENTION

The present invention provides a method for treating a cellulose-containing substrate comprising contacting a silicone composition comprising at least one polysiloxane or silicone resin containing at least one functional group comprising at least one dialkylacetal group, at least one anhydride group, at least one reactive group, or combinations thereof with the cellulose-containing substrate; and curing the silicone composition on the cellulose-containing substrate at a temperature in a range between about 25° C. and about 200° C.

The present invention further provides a formulation comprising an aqueous mixture or non-aqueous mixture of at least one polysiloxane or silicone resin containing at least one functional group comprising at least one dialkylacetal group, at least one anhydride group, at least one reactive group, or combinations thereof and optionally, at least one catalyst;

wherein the formulation adheres to a cellulose-containing substrate when the formulation is cured at a temperature in a range between about 25° C. and about 200° C. when the formulation is applied to the cellulose-containing substrate.

DETAILED DESCRIPTION OF THE INVENTION

The present invention includes a silicone composition which includes at least one polysiloxane or silicone resin containing at least one functional group capable of interacting with cellulose. The functional group in the silicone composition of the present invention enables adhesion of the polysiloxane or silicone resin to cellulose-containing surfaces under surface treatment conditions. The functional group comprises at least one dialkylacetal group, at least one anhydride group, at least one reactive group, or combinations thereof.

The present invention includes silicone compositions having the formula:

$$M_aM'_bD_cD'_dT_eT'_fQ_g$$

where the subscripts a, b, c, d, e, f and g are zero or a positive integer, subject to the limitation that the sum of the subscripts b, d and f is at least one; where M has the formula:

$$R^1{}_3SiO_{1/2},$$

M' has the formula:

$$(X)_hR^2{}_{3-h}SiO_{1/2},$$

D has the formula:

$$R^3{}_2SiO_{2/2},$$

D' has the formula:

$$(X)_{(2-i)}R_i{}^4SiO_{2/2},$$

T has the formula:

$$R^5SiO_{3/2},$$

T' has the formula:

$$(X)SiO_{3/2},$$

and Q has the formula $SiO_{4/2}$, where subscript h is in a range between 1 and 3; subscript i is 0 or 1; each $R^1$, $R^2$, $R^3$, $R^4$, $R^5$ is independently at each occurrence a hydrogen atom, $C_{1-30}$ alkyl, $C_{1-22}$ alkoxy, $C_{2-22}$ alkenyl, $C_{6-14}$ aryl, $C_{6-22}$ alkyl-substituted aryl, or $C_{6-22}$ aralkyl, any of which groups may be halogenated, for example, fluorinated to contain fluorocarbons such as $C_{1-22}$ fluoroalkyl, or may contain amino groups to form aminoalkyls, for example aminopropyl or aminoethylaminopropyl, or may contain polyether units of the formula $(CH_2CHR^6O)_k$ where $R^6$ is independently in each repeat unit $CH_3$ or H and "k" is in a range between about 4 and about 50; X, independently at each occurrence, represents a functional group that is capable of causing durable interactions with cellulose-containing substrates. The term "alkyl", as used in various embodiments of the present invention, is intended to designate both normal alkyl, branched alkyl, aralkyl, and cycloalkyl radicals. Normal and branched alkyl radicals are preferably those containing in a range between about 1 and about 30 carbon atoms, and include as illustrative non-limiting examples methyl, ethyl, propyl, isopropyl, butyl, tertiary-butyl, pentyl, neopentyl, hexyl, and dodecyl. Cycloalkyl radicals represented are preferably those containing between about 4 and about 12 ring carbon atoms. Some illustrative non-limiting examples of these cycloalkyl radicals include cyclobutyl, cyclopentyl, cyclohexyl, methylcyclohexyl, and cycloheptyl. Preferred aralkyl radicals are those containing between about 7 and about 14 carbon atoms. These include, but are not limited to, benzyl, phenylbutyl, phenylpropyl, and phenylethyl. Aryl radicals used in the various embodiments of the present invention are preferably those containing between about 6 and about 20 ring carbon atoms and contain at least one monocyclic or polycyclic moiety wherein a polycyclic may comprise fused or linked rings. Some illustrative non-limiting examples of these aryl radicals include phenyl, biphenyl, and naphthyl. An illustrative non-limiting example of a suitable halogenated moiety is trifluoropropyl.

According to the present invention, one important class of functional groups that is capable of causing durable interactions with cellulose-containing substrates is the dialkylacetal group. These groups have the general formula:

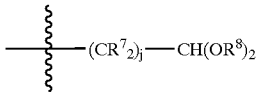

wherein $R^7$ and $R^8$ are alkyl groups as defined above for $R^1$, $R^2$, $R^3$, $R^4$ and $R^5$ and where j is in a range between about 2 and about 10. The carbon-carbon bonds can be interrupted by aryl groups or other ring structures. Aryl groups used in the various embodiments of the present invention are preferably those containing in a range between about 6 and about 20 carbon atoms and containing at least one monocyclic or polycyclic moiety wherein a polycyclic may comprise fused or linked rings. The aryl groups also may incorporate one or more substituents that are compatible with the applications described in this invention. Exemplary substituents include but are not limited to halogens, alkyls, aralkyls, alkaryls, aryls, alkoxy groups, and aryloxy groups.

In another embodiment of the present invention, "reactive group" as used herein includes any $C_1$–$C_{250}$ alkyl, aryl, or alkylaryl group where the $C_{1-250}$ group can be interrupted by or substituted with aromatic groups or aromatic-containing groups and which contains a leaving group that is capable of interacting with cellulose. The $C_{1-250}$ group may also contain one or more heteroatoms such as O, N, or S. Furthermore, the $C_{1-250}$ group may be unsubstituted or substituted with heteroatoms such as halogen. An exemplary reactive group comprises a chlorobenzyl moiety. Other examples of reactive groups of the present invention include, but are not limited to:

(I)

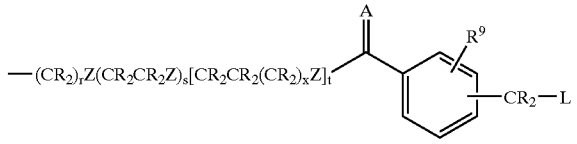

(II)

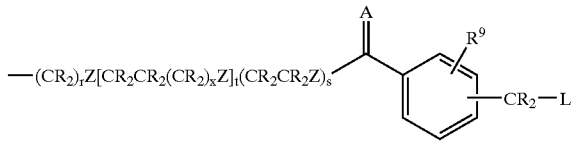

(III)

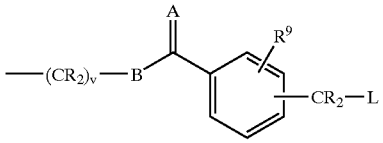

(IV)

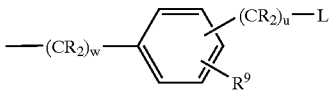

where r is in a range between about 1 and about 10, preferably 2 or 3;

s is in a range between about 0 and about 100, preferably 4 to 20;

t is in a range between about 0 and about 100, preferably in a range between about 0 and about 20, and most preferably 0;

u is in a range between about 1 and about 10, preferably 1;

v is in a range between about 1 and about 10, preferably 2 or 3;

w is 1 or 2;

x is 1 or 2;

Z is O, NOH, NOR or NR, preferably O;

L is a leaving group;

wherein R is independently at each occurrence hydrogen (H), $C_{1-30}$ alkyl, $C_{1-22}$ alkoxy, $C_{2-22}$ alkenyl, $C_{6-14}$ aryl, $C_{6-22}$ alkyl-substituted aryl, or $C_{6-22}$ aralkyl where the C can be unsubstituted or substituted with heteroatoms such as oxygen (O), nitrogen (N), sulfur (S) or halogen;

wherein $R^9$ is independently at each occurrence hydrogen (H), $C_{1-30}$ alkyl, $C_{1-22}$ alkoxy, $C_{2-22}$ alkenyl, $C_{6-14}$ aryl, $C_{6-22}$ alkyl-substituted aryl, $C_{6-22}$ aralkyl, or fused ring system which may or may not be fused to the phenyl group where the C can be unsubstituted or substituted with heteroatoms such as O, N, S or halogen. $R^9$ is preferably H. If $R^9$ represents an aryl group, it can be fused to the ring in Formulas (I) through (IV);

A is O, NOH, NOR, NR or S, preferably O;

B is O, NOH, NOR, NR or S, preferably O or NR and most preferably O;

and where the polysiloxane or the silicone resin is bound to the $(CR_2)_r$ (Formula I and II), $(CR_2)_v$ (Formula III), or $(CR_2)_w$ (Formula IV). Any of the linker structures shown in Formulas (I) through (IV) can also be interrupted with cycloaliphatic rings or aromatic rings. Substituents on the phenyl group of formulas (I), (II), (III), and (IV) may be present at any free valence site. The polysiloxane or silicone resin may or may not contain other functionalities by substitution at silicon atoms either the same as or distinct from those bound to the reactive groups described above, such as amine-, polyether-, alkyl-, or heteroalkyl-containing groups.

Illustrative leaving groups (L) include halides such as chloride, bromide and iodide; tosylate, mesylate, phosphate; cyclic leaving groups (that is, those in which the leaving group remains bound to the fragments illustrated as bound to L in formulas I–IV) or other cyclic leaving groups containing at least one heteroatom; and other leaving groups known to those skilled in the art. Preferred leaving groups are bromide, chloride, and iodide.

In an additional embodiment of the present invention, the polysiloxane or silicone resin is substituted with one or more anhydride groups. The anhydride of the present invention typically includes, for example, five membered ring anhydrides and six membered ring anhydrides. Five membered ring anhydrides are preferred. Examples include succinic, maleic and phthalic anhydrides as well as nadic anhydride (cis-5-norbornene-endo-2,3-dicarboxylic anhydride) and benzophenone tetradicarboxylic anhydride. Any group which can be chemically bound to a polysiloxane or silicone resin and which contains a five membered ring anhydride is suitable. Importantly, also covered in the scope of this invention is the substitution of a polysiloxane or silicone resin with one or more groups that are capable of forming an anhydride under substrate treatment or cure conditions.

The number of functional groups on a polysiloxane or silicone resin in the composition that are capable of causing durable interactions with cellulose-containing substrates is at least one. In preferred embodiments the average number of functional groups on a polysiloxane or silicone resin is in a range between about 1 and about 100, more preferably in a range between about 1 and about 20, still more preferably in a range between about 2 and about 10.

The polysiloxanes or silicone resins of the present invention are typically prepared by the hydrosilylation of an organohydrogen silicone and an unsaturated molecular precursor to the dialkylacetal group, reactive group, anhydride functional group, or combination thereof wherein the organohydrogen silicone has the formula:

$$M_aM^H_bD_cD^H_dT_eT^H_fQ_g$$

where the subscripts a, b, c, d, e, f and g are zero or a positive integer, subject to the limitation that the sum of the subscripts b, d and f is one or greater; M, D, T and Q are defined as above;

$M^H$ has the formula:

$$R^2_{3-h}H_hSiO_{1/2},$$

$D^H$ has the formula:

$$H_{2-1}R^4_1SiO_{2/2},$$

$T^H$ has the formula:

$$HSiO_{3/2},$$

where each $R^2$ and $R^4$ is independently as defined above; and subscript h and subscript i are defined above.

Hydrosilylation is typically accomplished in the presence of a suitable hydrosilylation catalyst. The catalysts preferred for use with these compositions are described in U.S. Pat. Nos. 3,715,334; 3,775,452; and 3,814,730 to Karstedt. A preferred catalyst contains platinum. Persons skilled in the art can easily determine an effective amount of platinum catalyst. Generally, an effective amount is in a range between about 0.1 parts per million and about 100 parts per million of the total silicone composition.

The organohydrogen silicone compounds that are the precursors to the compounds of the present invention may be prepared by the process disclosed in U.S. Pat. No. 5,420,221. The '221 patent discloses the redistribution of polydimethylsiloxane polymers with organohydrogen silicone polymers and optionally, added chain stopper, to provide a silicone with randomly-distributed hydride groups using a Lewis acid catalyst, preferably a phosphonitrilic compound. Hydride-terminated polymers can be made in related equilibration reactions.

Synthesis of the polysiloxane or silicone resin may also be performed by other methods known to those skilled in the art, for example, the hydrosilylation of a monomer such as methyldichlorosilane could be followed by co-hydrolysis with the appropriate dialkyldichlorosilane and optionally, chlorotrimethylsilane.

It is to be noted that as pure compounds, the subscripts describing the organohydrogen siloxane precursor and the hydrosilylation adduct of the present invention are integers as required by the rules of chemical stoichiometry. The subscripts will assume non-integral values for mixtures of compounds that are described by these formulas. The restrictions on the subscripts heretofore described for the stoichiometric subscripts of these compounds are for the pure compounds, not the mixtures.

The polysiloxane or silicone resin typically has a molecular weight in a range between about 100 and about 6,000,000, preferably in a range between about 250 and about 150,000, more preferably in a range between about 500 and about 100,000, and most preferably in a range between about 500 and about 75,000.

In one embodiment of the present invention, a polysiloxane- or silicone resin-containing composition includes a preponderance of a specific linear, branched, cross-linked, or cyclic polysiloxane or silicone resin. In other embodiments of the present invention, a polysiloxane- or silicone resin-containing composition comprises a mixture of polysiloxanes, mixture of silicone resins, or mixtures of polysiloxanes and silicone resins which may include linear, branched, cross-linked, and cyclic species. Also, suitable compositions may comprise one or more polysiloxanes, silicone resins, and mixtures thereof which may contain adventitious amounts of other species at a level in a range between about 0.0001 wt % and about 5 wt % based on total silicon-containing species, for example, arising during the synthesis process for said polysiloxanes or silicone resins. In illustrative examples, suitable compositions may contain adventitious amounts of $D_4$, or species containing Si—H, Si—OH, Si—O-alkyl bonds, and mixtures thereof.

Silicone compositions of the present invention that include at least one polysiloxane or silicone resin and at least one functional group typically impart durable benefits to materials such as textiles, including cellulose-containing surfaces such as natural fibers and regenerated fibers including blends. A particular advantage of the present invention is that the described functional groups enable the silicone composition to adhere to a cellulose-containing surface.

The silicone compositions can be delivered to a substrate, for example a cellulose-containing surface, from any appropriate aqueous or non-aqueous formulation, for example a water mixture or a water and catalyst mixture which can contain the silicone composition in a range between about 0.01% by weight and about 99% by weight based on the total formulation. The silicone composition may also be applied to the substrate as the neat material. Typically, the formulation may also include a catalyst, a typical example of which is an acid or a base. The catalyst is typically present in a range between about 0.01% and about 15% by weight based on the total formulation.

After application of the silicone composition onto the substrate, the composition can be cured over a period in a range between about 5 minutes and about 2 hours. Typically, the cure temperature is in a range between about 25° C. and about 200° C. Alternatively, the substituted silicone or silicone resin can be applied to the substrate neat and cured in the same manner.

In order that those skilled in the art will be better able to practice the present invention, the following examples are given by way of illustration and not by way of limitation.

The functional materials described in this invention can be synthesized in general in hydrosilation reactions between Si—H compounds or polymers and alkene-substituted reagents containing acetal groups (such as acrolein dimethylacetal), anhydride groups (such as allyl succinic anhydride) or reactive groups (such as vinyl benzylchloride). To evaluate the durability of interactions with cellulosic-based materials, filter paper was contacted with aqueous dispersions of polymers prepared by this general method, heated, extracted and then analyzed for residual silicone.

EXAMPLE 1

Dimethylacetal functional polymer $M^{R6}D_{22}M^{R6}$. In a round bottom flask, 25 grams (g) (14.0 millimole (mmol)) of 89066 (GE Silicones, $M^HD_{22}$ $M^H$) was mixed with 5 milliliters (mL) of toluene under a static nitrogen atmosphere. The resulting solution was heated to 75° C. To the warm solution was added Karstedt's catalyst (to give 50 parts per million Platinum), and then 3.42 g (33.6 mmol) of acrolein dimethylacetal dropwise over 5 minutes with stirring. The reaction mixture was heated with stirring overnight. Next, the reaction mixture was allowed to cool to room temperature after which time the volatile materials were removed under vacuum to yield a clear, dark, low viscosity liquid: $^1$H NMR ($CD_2Cl_2$) δ: 4.24 (m, 2.0H, $CH_2CH(OCH_3)_2$), 3.27 (s, 12.0H, $CH(OCH_3)_2$), 1.55 (m, 4.0H, $SiCH_2CH_2CH$), 0.54 (m, 4.0H, $SiCH_2CH_2CH$), 0.12 (m, 132.0H, SiMe). This reaction can be varied in many ways. For example, depending on reaction temperature, heating overnight is not necessary, solvent is not necessarily needed, and less platinum can be used to achieve a near colorless final product. Note that some percentage of the final product, depending on reaction conditions, may contain functional groups that result from α-addition rather than β-addition across the double bond. This does not affect the use or usefulness of the product.

EXAMPLE 2

Dimethylacetal substituted polymer $M^{Bu}D_{18}M^{R6}$. To a 500 mL round bottom flask containing a stir bar was added 75.0 g (45.5 mmol) of the hydride silicone $M^{Bu}D_{18}$ $M^{H}$, followed by toluene (EM Science, 73.4 g). The solution was stirred and heated to 78° C. at which point Karstedt's catalyst (GE Silicones product 89023, 9.9 wt % Pt, 76.0 ppm Pt in reaction mixture) was added dropwise to the mixture. Acrolein dimethylacetal (4.0 mL, 45.2 mmol) was added dropwise over seven minutes. The solution heated to 97° C. overnight with stirring. A vacuum strip of the reaction mixture at 60° C. for 4 h followed by drying under reduced pressure gave a clear, dark bronze, low viscosity liquid in 95.3% yield (75.5 g). $^1$H NMR ($CD_2Cl_2$) δ: 4.23 (t, 1.0H, $CH_2CH(OCH_3)_2$), 3.26 (s, 6.0H, $CH(OCH_3)_2$), 1.54 (m, 2.0H, $SiCH_2CH_2CH$), 1.31 (m, 4.0H, $SiCH_2C_2H_4CH_3$), 0.88 (t, 3.0H, $SiC_3H_6CH_3$), 0.54 (m, 4.0H, $SiCH_2C_3H_7$ and $SiCH_2CH_2CH$), 0.07 (s, 138.0H, SiMe). This reaction can be varied in many ways as described under Example 1.

Silicone compositions of Examples 1 and 2 are illustrated as follows:

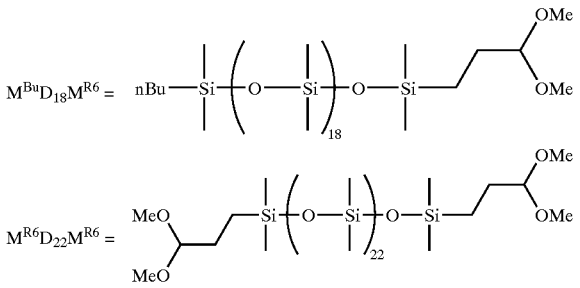

EXAMPLE 3

The polymer $MD_{49}D^{R6}{}_{3.4}M$ was prepared as well by the procedure described above for the mono- and difunctional polymers in Examples 1 and 2.

EXAMPLE 4

Filter paper experiments with acetal-functional polymers. Experiments were performed in which cellulosic filter paper was treated with aqueous dispersions of the new polymers, extracted and analyzed for durable silicone.

Filter paper (1.5 cm in diameter) was mixed with a 10 mL aqueous mixture containing 3% silicone by weight and 5% Freecat acid catalyst (BF Goodrich) for 3 min at room temperature using an automatic shaker. The filter paper sample was then removed and placed in an aluminum pan (one per paper) and heated in an oven at 170° C. (temperature of oven floor) for 5 min under reduced pressure to prevent moisture condensation on the oven window. The paper sample was then removed and washed with acetone (3×50 mL) on a Hirsch funnel. After the 3×50 mL acetone washes, the samples were then soaked overnight in 20 mL acetone at room temperature. Following this they were washed with an additional 10 mL of acetone, dried under air at room temperature and analyzed by XPS (x-ray photoelectron spectroscopy) and XRF (x-ray fluorescence). Experiments were performed separately with $M^{R6}D_{22}M^{R6}$, $M^{Bu}D_{18}M^{R6}$, $MD_{49}D^{R6}{}_{34}M$, and a PDMS control (see Table 1). All experiments were done in triplicate.

The samples were analyzed to determine durable silicone in terms of total durable deposition (XRF) and extent of surface coverage (XPS). These results are described in Table 1. Silicone analyzed is that which remained on the filter paper following the extraction process. This is considered "durable" silicone.

TABLE 1

Results of silicon analysis after treatment and extraction.

| Silicone polymer | % surface Si (by XPS) | % surface coverage[1] | Total durable silicone (by XRF, kcps) |
|---|---|---|---|
| UCT0039 | 1.2% | 5% | 0.067 |
| 20 csk PDMS fluid ($MD_{25}M$) | | | |
| $M^{Bu}D_{18}M^{R6}$ | 10.1% | 45% | 0.449 |
| $M^{R6}D_{22}M^{R6}$ | 9.0% | 43% | — |
| $M^{R6}D_{22}M^{R6}$ [2] | 15.8% | 72% | 1.008 |
| $MD_{49}D^{R6}{}_{3.4}M$ | 18% | 79% | 1.540 |

[1]Reported as a percentage of the theoretical value for total surface coverage as defined by XPS (complete coating at least 50Å thick).
[2]Samples within this triplicate set of experiments were washed with acetone (3 × 50 mL) but neither soaked overnight nor re-washed.

The results in Table 1 clearly show that filter paper treated with the dimethylacetal substituted polymers contained durable silicone that withstood the solvent extraction process, an observation that is not made with filter paper treated with the otherwise non-functional poly (dimethylsiloxane) fluid.

EXAMPLE 5

Benzylchloride-substituted polymer $M^{R7}D_{22}M^{R7}$. To a 500 mL round bottom flask containing a stir bar was added 119.2 g (66.67 mmol) of 89066 (GE Silicones, $M^{H}D_{22}M^{H}$). 2,6-di-t-butylphenol (68.5 mg, 502 ppm) was added followed by Pt in the form of Karstedt's catalyst (26.8 mg, GE Silicones product 89023, 9.9 wt % Pt). Vinylbenzylchloride (19.03 g, 146.7 mmol, Aldrich) was added dropwise over ten minutes while the reaction heated to 56° C. After 22 h, the reaction was allowed to cool room temperature and it was stripped under reduced pressure at 125° C. for 18 h. The product was isolated in 96.0% yield (134.0 g) as a clear, dark brown, viscous liquid. This same procedure was used to make $M^{R7}D_8M^{R7}$, $M^{Bu}D_{18}M^{R7}$ and $M^{Bu}D_{10}M^{R7}$. Representative NMR spectroscopic data is as follows: $M^{R7}D_{22}M^{R7}$ $_1$H NMR ($CD_2Cl_2$): 7.26 (m, 6.0H, phenyl), 7.10 (d, 2.0H, phenyl), 4.57 (d, 4.0H, $CH_2Cl$), 2.66 (m, 2.67H, $SiCH_2CH_2$), 2.20 (m, 0.67H, SiCH(Me)), 1.36 (d, 2.0H, SiCH(Me)), 0.90 (m, 2.67H, $SiCH_2CH_2$), 0.07 (s, 144.0H, SiMe). $M^{Bu}D_{18}M^{R7}$ $^1$H NMR ($CD_2Cl_2$): 7.24 (m, 3.0H, phenyl), 7.10 (d, 1.0H, phenyl), 4.57 (d, 2.0H, $CH_2Cl$), 2.67

(m, 1.33H, $SiCH_2CH_2$), 2.22 (m, 0.33H, SiCH(Me)), 1.36 (m, 4.99H, SiCH(Me) and $SiCH_2C_2H_4CH_3$), 0.90 (m, 4.33H, $SiC_3H_6CH_3$ and $SiCH_2CH_2Ar$), 0.55 (m, 2.0H, $SiCH_2C_3H_7$), 0.09 (s, 120.0H, SiMe). Note that hydrosilation reactions with vinylbenzyl chloride can also give products with structures resulting from α-addition as well as β-addition. Isomer mixtures of vinylbenzylchloride can also be used, such as mixtures of meta- and para-substituted vinylbenzylchloride.

Silicone compositions of Example 5 are illustrated as follows:

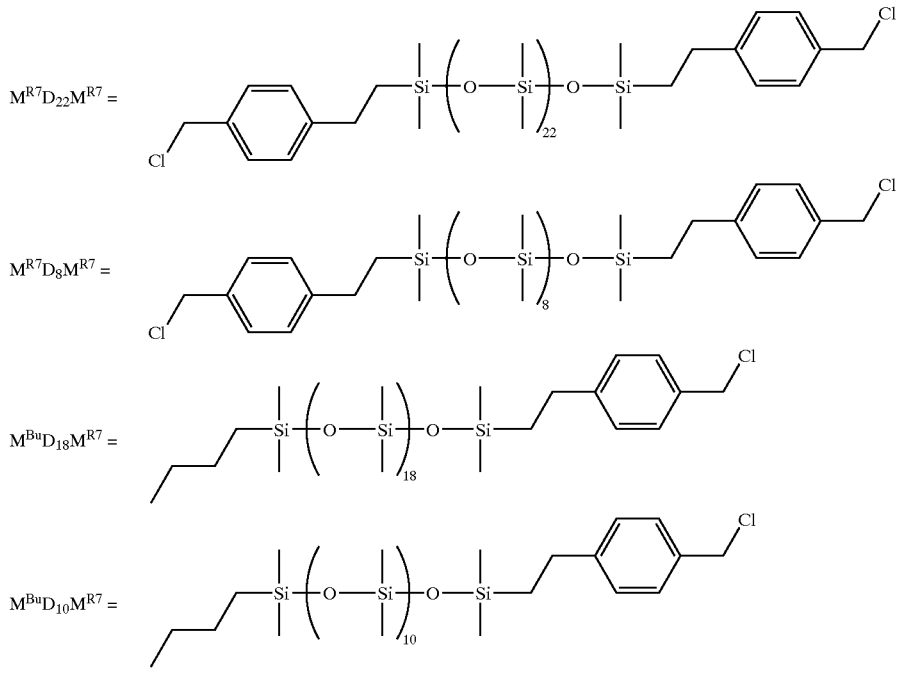

EXAMPLE 6

Treatment of fabric with benzylchloride-substituted silicone polymer in the presence of saturated $NaHCO_3$: A 1×2 $in^2$ piece of cotton fabric (TestFabric brand, lot #9684) was soaked in a 50 mL aqueous solution of saturated sodium bicarbonate for thirty minutes. The fabric was removed and saturated with 2 mL of an acetone solution containing 3% by weight $M^{R7}D_8M^{R7}$. The fabric was heated in a 180° C. oven for ten minutes. Following cooling, the fabric was washed consecutively with 200 mL 0.1N HCl, 500 mL water, 200 mL dichloromethane and 500 mL acetone. The sample, referred to as C804-134 in Table 2, was dried and submitted for XPS analysis.

EXAMPLE 7

Treatment of fabric with benzylchloride-substituted silicone polymer in the presence of 0.1 N NaOH: A 1×2 $in^2$ piece of fabric (TestFabric brand, lot #9684) was soaked in a 50 mL aqueous solution of 0.1N NaOH for thirty minutes. The fabric was removed and saturated with 2 mL of an acetone solution containing 3% by weight $M^{R7}D_8M^{R7}$. The fabric was heated in a 180° C. oven for ten minutes. Following cooling, the fabric was washed consecutively with 200 mL 0.1N HCl, 500 mL water, 200 mL dichloromethane and 500 mL acetone. The sample, referred to as C804-135 in Table 2, was dried and submitted for XPS analysis.

EXAMPLE 8

Control Experiments: A 1×2 $in^2$ piece of fabric (TestFabric brand, lot #9684) was saturated with 2 mL of an acetone solution containing 3% by weight of $M^{R7}D_8M^{R7}$. The fabric was heated in a 180° C. oven for ten minutes. Following cooling, the fabric was washed consecutively with 200 mL 0.1N HCl, 500 mL water, 200 mL dichloromethane and 500 mL acetone. The sample, referred to as 2697-50A in Table 2, was dried and submitted for XPS analysis.

A 1×2 $in^2$ piece of fabric (TestFabric brand, lot #9684) was soaked in a 50 mL aqueous solution of saturated sodium bicarbonate for thirty minutes. The fabric was removed and saturated with 2 mL of an acetone solution containing 3% by weight of $M^{R7}D_8M^{R7}$. The fabric was kept at room temperature for thirty minutes. The sample was then washed consecutively with 200 mL 0.1N HCl, 500 mL water, 200 mL dichloromethane and 500 mL acetone. The sample, referred to as 2697-50B in Table 2, was dried and submitted for XPS analysis.

Table 2 gives the atom % for surface composition as determined by XPS for Examples 6, 7, and 8.

TABLE 2

XPS data collected following treatment and extraction.

| Sample | C | O | Si | Other |
|---|---|---|---|---|
| C804-134 | 64.7 | 20.2 | 12.8 | Na 0.1 Cl 1.3 |
| C804-135 | 58.2 | 23.9 | 14.8 | Al 1.5 Cl 1.3 |
| 2697-50A | 62.5 | 32.4 | 2.4 | N 2.6 Ca 0.2 |
| 2697-50B | 69.0 | 27.8 | 1.1 | N 2.1 |

EXAMPLE 9

Anhydride-substituted polymer $M^{R8}D_{22}M^{R8}$. To a 500 mL round bottom flask containing a stir bar was added 109.9 g (61.47 mmol) of 89066 (GE Silicones, $M^HD_{22}M^H$). Cis-5-norbornene-endo-2,3-dicarboxylic anhydride (20.12 g, 122.6 mmol, TCI) was added piecewise as a solid, followed by toluene (94 wt %). The platinum catalyst was added in the form of Karstedt's catalyst (134 mg, 102 ppm Pt), and the mixture was placed under an $N_2$ atmosphere. The mixture was stirred overnight (18 h) at 96° C. becoming homogeneous after 2 h. After this time, the reaction mixture was cooled to room temperature and the volatile materials were removed using rotary evaporation. The viscous polymer product was dissolved in hexane (~90 wt %) and washed with acetonitrile (⅓ by volume). The polymer/hexane layer was separated by centrifugation after which time the volatile materials were removed under reduced pressure. The product was isolated in 78.6% yield (102.2 g) as a clear, dark brown, viscous liquid. $^1H$ NMR ($CD_2Cl_2$) δ: 3.40 (br m, 4.0H, endo H), 2.79 (br m, 4.0H, bridgehead H), 1.76 (dt, 4.0H, bridged $CH_2$, 1.56 (br m, 4.0H, $SiCHCH_2$), 0.64 (dt, 2.0H, SiCH), 0.07 (s, 144H, SiMe).

EXAMPLE 10

The procedure of Example 9 was also used to synthesize $M^{Bu}D_{18}M^{R8}$ and $M^{Bu}D_{10}M^{R8}$. The $M^{R8}D_8M^{R8}$ and $M^{R8}D_{3.8}M^{R8}$ polymers were made by this procedure except that no hexane/acetonitrile wash was performed. NMR spectroscopic data is given for $M^{Bu}D_{18}M^{R8}$: $^1H$ NMR ($CD_2Cl_2$) δ: 3.41 (br m, 2.0H, endo H), 2.79 (br m, 2.0H, bridgehead H), 1.77 (dt, 2.0H, bridged $CH_2$), 1.65 and 1.56 (br m, 2.0H, $SiCHCH_2$), 1.31 (m, 4.0H, $SiCH_2C_2H_4CH_3$), 0.87 (t, 3.0H, $SiC_3H_6CH_3$), 0.64 (dt, 1.0H, SiCH), 0.54 (m, $SiCH_2C_3H_7$), 0.07 (s, 120.0H, SiMe).

The silicone compositions of Examples 9 and 10 are illustrated as follows:

EXAMPLE 11

Filter paper experiments. Experiments were performed in which cellulosic filter paper was treated with aqueous dispersions of the anhydride functional silicone polymers, extracted and analyzed for durable silicone.

Filter paper (1.5 cm in diameter) was mixed with a 10 mL aqueous mixture containing 3% silicone by weight and catalyst (for example, Freecat 9, 5% by weight, BF Goodrich) for 3 min at room temperature using an automatic shaker. The filter paper samples were then removed and placed in an aluminum pan (one per paper) and heated in an oven at 170° C. (temperature of oven floor) for 5 min under reduced pressure to prevent moisture condensation on the oven window. The paper samples were then removed and washed with acetone (3×50 mL) on a Hirsch funnel. Following this, the samples were soaked overnight in 20 mL acetone at room temperature. At this point they were washed with an additional 10 mL of acetone, dried under air at room temperature and analyzed by XPS and XRF. The experiments were done in triplicate. No catalyst was used with the PDMS control.

The samples were analyzed to determine durable silicone in terms of total durable deposition (XRF) and extent of surface coverage (XPS). These results are described in Table 3. As in the experiments described in Table 1, silicone analyzed is that which remained on the filter paper following the extraction process. This is considered "durable" silicone.

$M^{R8}D_{22}M^{R8}$ =

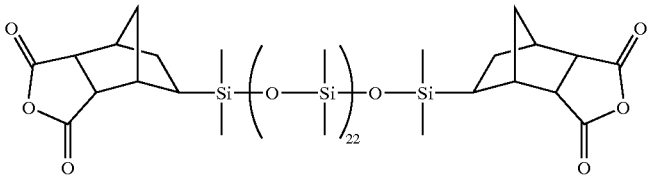

$M^{R8}D_8M^{R8}$ =

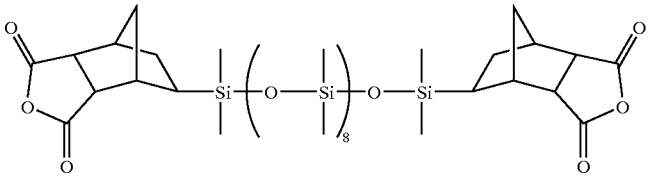

$M^{Bu}D_{18}M^{R8}$ =

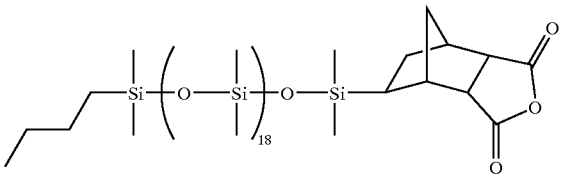

$M^{Bu}D_{10}M^{R8}$ =

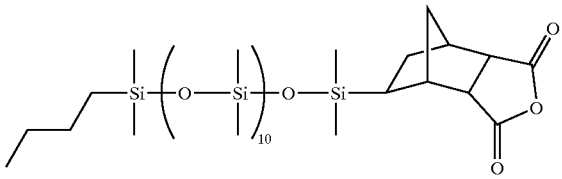

TABLE 3

Results of silicon analysis after treatment and extraction.

| Silicone polymer | Catalyst | % surface Si (by XPS) | % surface coverage[1] | Total durable silicone (by XRF, kcps) |
|---|---|---|---|---|
| UCT0039 20 csk PDMS fluid ($MD_{25}M$) | none | 1.2% | 5% | 0.067 |
| $M^{R8}D_{22}M^{R8}$ | Freecat 9 | 8.1% | 40% | — |
| $M^{Bu}D_{18}M^{R8}$ | None | 3.6% | 17% | 0.2945 |
| | Freecat 9 | 6.9% | 33% | 0.348 |
| | $Na_2HPO_4$ | 8.0% | 38% | 1.837 |
| | $NaH_2PO_2$ | 8.8% | 42% | 1.793 |
| | $(PhO)PO(ONa)_2$ | 8.7% | 41% | 0.860 |
| | $Zn(BF_4)_2$ | 3.3% | 16% | 0.264 |

[1]Reported as a percentage of the theoretical value for total surface coverage as defined by XPS (complete coating at least 50Å thick).

The results in Table 1 clearly show that filter paper treated with the anhydride substituted polymers contained durable silicone that withstood the solvent extraction process, an observation that is not made with filter paper treated with the otherwise non-functional poly(dimethylsiloxane) fluid.

The treatment baths used in the filter paper experiments were dispersions of silicone in water with catalyst. Silicone emulsions can also be used effectively, and are recommended when the polymer molecular weight is not low. An example of a test emulsion of $M^{R8}D_{134}M^{R8}$ is provided: A mixture of 0.014 g of Brij 30 and 0.009 g of Brij 35 was prepared and then stirred while heated at 80° C. until a clear solution formed. At this point, 0.1 g of $M^{R8}D_{134}M^{R8}$ was added and heating was resumed. To this mixture was then added 0.1 g of water, and the mixture was stirred until uniform in appearance. An additional 1.0 mL of water was then added dropwise. The mixture was then diluted to 10 mL with water, heating was stopped and the mixture was vigorously shaken to produce a hazy translucent fluid useful as a filter paper treatment bath.

While typical embodiments have been set forth for the purpose of illustration, the foregoing description should not be deemed to be a limitation on the scope of the invention. Accordingly, various modifications, adaptations, and alternatives may occur to one skilled in the art without departing from the spirit and scope of the present invention.

What is claimed is:

1. A method for treating a cellulose-containing substrate comprising contacting a silicone composition with the cellulose-containing substrate in the presence of a base; wherein the silicone composition comprises at least one polysiloxane or silicone resin containing at least one reactive functional group, the silicone composition having the formula $$M_aM'_bD_cD'_dT_eT'_fQ_g$$

where the subscripts a, b, c, d, e, f and g are zero or a positive integer, subject to the limitation that the sum of the subscripts b, d and f is at least one; where M has the formula:

$$R^1{}_3SiO_{1/2},$$

M' has the formula:

$$(X)_hR^2{}_{3-h}SiO_{1/2},$$

D has the formula:

$$R^3{}_2SiO_{2/2},$$

D' has the formula:

$$(X)_{(2-i)}{}^iR^4SiO_{2/2},$$

T has the formula:

$$R^5SiO_{3/2},$$

T' has the formula:

$$(X)SiO_{3/2},$$

and Q has the formula $SiO_{4/2}$, where subscript h is in a range between 1 and 3; subscript i is 0 or 1; each $R^1$, $R^2$, $R^3$, $R^4$, $R^5$ is independently at each occurrence a hydrogen atom, $C_{1-30}$ alkyl, $C_{1-22}$ alkoxy, $C_{2-22}$ alkenyl, $C_{6-14}$ aryl, $C_{6-22}$ alkyl-substituted aryl, $C_{6-22}$ aralkyl, $C_{1-22}$ fluoroalkyl, polyether, or amino alkyl; and each X is the reactive group; and curing the silicone composition on the cellulose-containing substrate at a temperature in a range between about 25° C. and about 200° C.

2. The method in accordance with claim 1, wherein the functional group comprises a reactive group wherein the reactive group comprises a $C_1$–$C_{250}$ alkyl, aryl, or alkylaryl group and a leaving group;

wherein the leaving group comprises bromide, chloride, or iodide.

3. The method in accordance with claim 2, wherein the reactive group comprises a chlorobenzyl moiety.

4. The method in accordance with claim 1, wherein the average number of functional groups on the polysiloxane or silicone resin is in a range between about 1 and about 100.

5. The method in accordance with claim 4, wherein the average number of functional groups on the polysiloxane or silicone resin is in a range between about 1 and about 20.

6. The method in accordance with claim 5, wherein the average number of functional groups on the polysiloxane or silicone resin is in a range between about 2 and about 10.

7. The method in accordance with claim 1, wherein the cellulose-containing substrate comprises natural fibers, regenerated fibers, blends or combinations thereof.

8. The method in accordance with claim 7, wherein the cellulose-containing substrate comprises natural fibers.

9. The method in accordance with claim 1, wherein the base is present in an amount corresponding to between about 0.01 weight percent and about 15 weight percent of a formuation comprising the silicone composition being contacted with the cellulose-containing substrate.

* * * * *